US011509039B2

(12) United States Patent
Kim et al.

(10) Patent No.: US 11,509,039 B2
(45) Date of Patent: Nov. 22, 2022

(54) ANTENNA MODULE AND ANTENNA APPARATUS

(71) Applicant: SAMSUNG ELECTRO-MECHANICS CO., LTD., Suwon-si (KR)

(72) Inventors: Nam Ki Kim, Suwon-si (KR); Jeong Ki Ryoo, Suwon-si (KR); Seung Goo Jang, Suwon-si (KR); Sang Hyun Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 17/000,679

(22) Filed: Aug. 24, 2020

(65) Prior Publication Data

US 2020/0388906 A1 Dec. 10, 2020

Related U.S. Application Data

(63) Continuation of application No. 15/994,350, filed on May 31, 2018, now Pat. No. 10,790,573.

(30) Foreign Application Priority Data

Dec. 26, 2017 (KR) ..... 10-2017-0179223

(51) Int. Cl.
*H01Q 1/22* (2006.01)
*H01Q 9/28* (2006.01)
(Continued)

(52) U.S. Cl.
CPC ..... *H01Q 1/243* (2013.01); *H01Q 1/2283* (2013.01); *H01Q 1/38* (2013.01); *H01Q 9/065* (2013.01);
(Continued)

(58) Field of Classification Search
CPC ..... H01Q 1/2283; H01Q 1/22; H01Q 1/24; H01Q 1/243; H01Q 1/38; H01Q 21/06;
(Continued)

(56) References Cited

U.S. PATENT DOCUMENTS 2,701,308 A * 2/1955 James ..... H01Q 5/49 343/794
2,886,813 A * 5/1959 Hings ..... H01Q 19/28 343/819
(Continued)

FOREIGN PATENT DOCUMENTS

CN 102694245 A 9/2012
CN 102714357 A 10/2012
(Continued)

OTHER PUBLICATIONS

Chinese Office Action dated Aug. 27, 2020 in counterpart Chinese Patent Application No. 201810901516.1 (9 pages in English and 6 pages in Chinese).
(Continued)

*Primary Examiner* — Tho G Phan
(74) *Attorney, Agent, or Firm* — NSIP Law

(57) ABSTRACT

An antenna module includes a connection member, an integrated circuit (IC) on a first surface thereof, and an antenna package on a second surface thereof. The connection member includes a wiring layer and an insulating layer. The IC is electrically connected to the wiring layer. The antenna package includes first antenna members and feed vias each electrically connected to a corresponding one of the first antenna members and a corresponding wire of the wiring layer. A feed line is electrically connected to a wire of the wiring layer and extends in a side direction of the second surface, a second antenna member is electrically connected to the feed line and is configured to transmit and/or receive an RF signal in the side direction, and a
(Continued)

director member is spaced apart from the second antenna member in the side direction and has an inside boundary oblique to the second antenna member.

20 Claims, 13 Drawing Sheets

(51) Int. Cl.
*H01Q 1/24* (2006.01)
*H01Q 21/06* (2006.01)
*H01Q 9/06* (2006.01)
*H01Q 1/38* (2006.01)
*H01Q 5/48* (2015.01)

(52) U.S. Cl.
CPC ..... *H01Q 21/062* (2013.01); *H01Q 21/065* (2013.01); *H01Q 5/48* (2015.01)

(58) Field of Classification Search
CPC ..... H01Q 21/062; H01Q 21/065; H01Q 5/48; H01Q 9/06; H01Q 9/065; H01Q 9/42; H01Q 9/28
See application file for complete search history.

(56) References Cited

U.S. PATENT DOCUMENTS

| | | | | |
|---|---|---|---|---|
| 3,092,835 | A * | 6/1963 | Jaytanie | H01Q 5/49 343/802 |
| 4,381,566 | A * | 4/1983 | Kane | H01Q 1/36 343/713 |
| 6,249,260 | B1 * | 6/2001 | Holloway | H01Q 1/38 343/795 |
| 7,215,296 | B2 | 5/2007 | Abramov et al. | |
| 7,477,204 | B2 * | 1/2009 | Lin | H01Q 3/242 343/795 |
| 8,912,960 | B1 | 12/2014 | Andrenko et al. | |
| 9,819,098 | B2 | 11/2017 | Gu et al. | |
| 9,972,892 | B2 | 5/2018 | Noori et al. | |
| 2005/0153756 | A1 | 7/2005 | Sato et al. | |
| 2012/0242547 | A1 | 9/2012 | Fuji et al. | |
| 2012/0263244 | A1 | 10/2012 | Kyles et al. | |
| 2012/0287019 | A1 | 11/2012 | Sudo et al. | |
| 2013/0120209 | A1 * | 5/2013 | Mak | H01Q 21/205 343/819 |
| 2014/0140031 | A1 | 5/2014 | Fujita et al. | |
| 2014/0313093 | A1 * | 10/2014 | Smith | H01Q 21/26 343/795 |
| 2014/0361946 | A1 * | 12/2014 | Ganchrow | H01Q 1/48 343/859 |
| 2015/0207216 | A1 | 7/2015 | Fujita et al. | |
| 2016/0294052 | A1 | 10/2016 | Baek et al. | |
| 2017/0229769 | A1 | 8/2017 | Yokoyama et al. | |
| 2019/0027804 | A1 | 1/2019 | Kim et al. | |
| 2020/0112100 | A1 | 4/2020 | Ryoo et al. | |

FOREIGN PATENT DOCUMENTS

| | | | |
|---|---|---|---|
| CN | 103563166 | A | 2/2014 |
| CN | 104733846 | A | 6/2015 |
| CN | 105140632 | A | 12/2015 |
| CN | 107078406 | A | 8/2017 |
| JP | 2001-244731 | A | 9/2001 |
| JP | 2005-203878 | A | 7/2005 |
| JP | 3734666 | B2 | 1/2006 |
| JP | 2015-91110 | A | 5/2015 |
| JP | 5971566 | B2 | 8/2016 |
| KR | 10-2013-0141680 | A | 12/2013 |
| KR | 10-2015-0130046 | A | 11/2015 |
| KR | 10-1635579 | B1 | 7/2016 |
| WO | WO 2012/129426 | A2 | 9/2012 |

OTHER PUBLICATIONS

Korean Office Action dated Jan. 9, 2019 in Korean Patent Application No. 10-2017-0179223 (6 pages in English, 5 pages in Korean).
Chinese Office Action dated Apr. 7, 2020 in counterpart Chinese Patent Application No. 201810901516.1 (11 pages in English and 8 pages in Chinese).

* cited by examiner

ANTENNA MODULE AND ANTENNA APPARATUS

CROSS-REFERENCE TO RELATED APPLICATIONS

This application is a continuation of U.S. patent application Ser. No. 15/994,350 filed on May 31, 2018, now U.S. Pat. No. 10,790,573 issued on Sep. 29, 2020, which claims the benefit under 35 USC 119(a) of Korean Patent Application No. 10-2017-0179223 filed on Dec. 26, 2017, in the Korean Intellectual Property Office, the entire disclosures of which are incorporated herein by reference for all purposes.

BACKGROUND

1. Field

This application relates to an antenna module and an antenna apparatus.

2. Description of the Background

Recently, millimeter wave (mmWave) communications including 5th generation (5G) communications have been actively researched, and research into the commercialization of an antenna module able to cohesively implement millimeter wave communications is being actively undertaken.

Conventionally, an antenna module providing a millimeter wave communications environment includes a structure in which an integrated circuit (IC) and an antenna are disposed on a board and are connected to each other by a coaxial cable in order to satisfy a high level of antennal performance (e.g., a transmission and reception rate, gain, directivity, and the like) according to a high frequency.

However, such a structure may cause a reduction of antenna layout space, a restriction of the degree of freedom of an antenna shape, an increase in interference between the antenna and the IC, and an increase in the size and cost of the antenna module.

The above information is presented as background information only to assist with an understanding of the present disclosure. No determination has been made, and no assertion is made, as to whether any of the above might be applicable as prior art with regard to the disclosure.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna module includes a connection member, an integrated circuit (IC) on a first surface thereof, and an antenna package on a second surface thereof. The connection member includes one or more wiring layer and one or more insulating layer. The IC is electrically connected to the one or more wiring layer. The antenna package includes first antenna members configured to transmit and/or receive a radio frequency (RF) signal in a first direction, and first feed vias each electrically connected to a corresponding one of the first antenna members and to a corresponding wire of the one or more wiring layer. A feed line is electrically connected to a wire of the one or more wiring layer and extending in a side direction of the second surface. A second antenna member is electrically connected to the feed line and configured to transmit and/or receive a RF signal in a second direction different than the first direction; and a director member spaced apart from the second antenna member in the second direction away from the center of the connection member and having an inside boundary disposed oblique to the second antenna member.

At the inside boundary, ends of the director member may be spaced a greater distance from the second antenna member than a center of the director member.

The second antenna member may include a dipole form or a folded dipole form including a first pole and a second pole. The director member may include a first portion parallel to the first pole and the second pole, a second portion oblique to the first pole and the second pole, a third portion parallel to the first pole and the second pole, a fourth portion oblique to the first pole and the second pole, and a fifth portion parallel to the first pole and the second pole connected to each other in order from the first portion to the fifth portion.

An angle of inclination of the second portion and an angle of inclination of the fourth portion in the director member may be greater than or equal to 5° and less than or equal to 14°.

The director member may be disposed to overlap between the first pole and the second pole when viewing the second antenna member in the second direction.

The director member may be longer than a length of the first pole, longer than a length of the second pole, and shorter than a unified length of the first pole and the second pole.

The director member may include a first portion protruding toward the first pole and a second portion protruding toward the second pole.

The director member may include a center portion protruding toward the second antenna member.

A thickness of the director member at an oblique portion of the inside boundary may be less than that of the director member at a portion of the inside boundary parallel to the second antenna member.

The connection member may further include one or more director via connected to the director member to dispose the inside boundary of the director member oblique.

The connection member may further include a second feed via electrically connected between the feed line and the second antenna member.

The connection member may further include a ground layer disposed on a same level as the feed line in the connection member and spaced apart from the feed line and shielding vias disposed extending parallel to each other along a boundary of the ground layer.

The antenna package may further include a dielectric layer disposed to surround a side surface of each of the first feed vias and having a height greater than that of the one or more insulating layer, and a plating member disposed in the dielectric layer to surround the side surface of each of the first feed vias.

In another general aspect, an antenna apparatus includes first and second feed lines each electrically connected to an integrated circuit (IC), first and second poles electrically connected to the first and second feed lines, respectively, and configured to transmit and/or receive a radio frequency (RF) signal in a predetermined direction, and a director member spaced apart from the first and second poles, disposed to overlap between the first and second poles when viewing the first and second poles in the predetermined direction, and having an oblique inside boundary facing the first and second poles, wherein distances between ends of the director member and the first and second poles are greater than distances between a center thereof and the first and second poles.

The antenna apparatus may further include a ground layer spaced apart from the first and second poles in a direction opposite to the director member and disposed to surround at least portions of the first and second feed lines. A length of a boundary toward the first and second poles in the ground layer may be longer than a unified length of the first pole and the second pole. The director member may be shorter than the unified length of the first and second poles.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

An aspect of the present disclosure provides an antenna module and an antenna apparatus.

Figure 1:
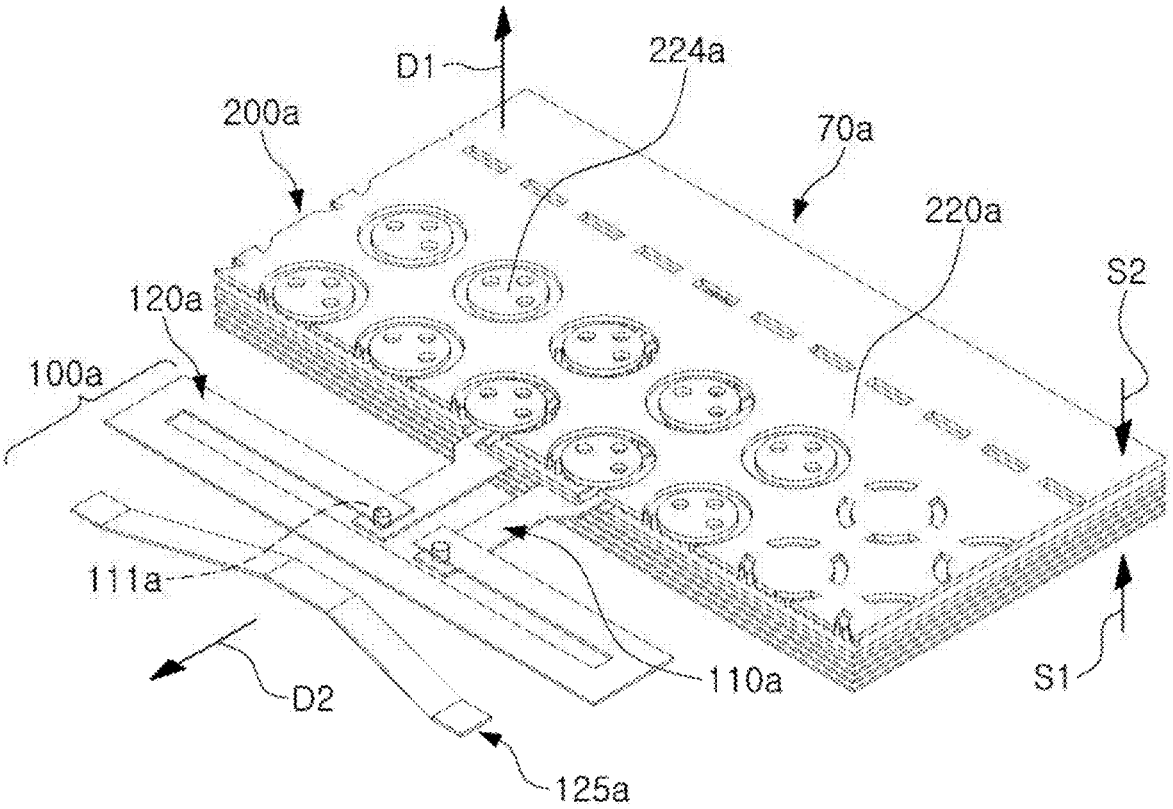
FIG. 1 is a view illustrating an example of an antenna module and an antenna apparatus according to a first embodiment of the present disclosure.

FIG. 1 is a view illustrating an example antenna module and an antenna apparatus according to a first embodiment of the present disclosure.

Referring to FIG. 1, an antenna module 70*a* includes a connection member 200*a*, an integrated circuit (IC) (1301*b*, 1300*a* described later with reference to FIGS. 8 and 9), and an antenna apparatus 100*a*. The connection member 200*a* includes one or more wiring layer and one or more insulating layer, and provides a first surface S1 (e.g., a lower surface) on which an integrated circuit (IC) is disposed and a second surface S2 (e.g., an upper surface) on which an antenna package 220*a* is disposed.

The antenna package 220*a* may be implemented to be homogeneous or heterogeneous with respect to the connection member 200*a*, and to transmit and/or receive (hereinafter transmit/receive) a radio frequency (RF) signal in a first direction D1 in which the second surface S2 of the connection member 200*a* is directed, that is, in a direction having a component generally perpendicular to the second surface S2. Therefore, the antenna module according to the first embodiment may form a radiation pattern in the first direction D1 so that the RF signal is transmitted and/or received (hereinafter transmitted/received) in the first direction D1.

The antenna package 220*a* includes first director members 224*a* disposed above corresponding first antenna members 1115*b*, first feed vias 1120*b*, a dielectric layer 1140*b*, an encapsulation member 1150*b*, and a plating member 1160*b*, described later with reference to FIGS. 8-10.

Referring to FIG. 1, the antenna apparatus 100*a* includes a feed line 110*a*, a second antenna member 120*a*, and a second director member 125*a*. Accordingly, the antenna module 70*a* and the antenna apparatus 100*a* may form a radiation pattern in a second direction D2 (e.g., a side surface) so that the RF signal is transmitted/received in the second direction D2, and may omni-directionally expand the transmission and/or reception (hereinafter transmission/reception) direction of the RF signal.

The feed line 110*a* is electrically connected to a wire of the one or more wiring layer. That is, the feed line 110*a* transmits the RF signal to the IC through the one or more wiring layer, and/or receives the RF signal from the IC through the one or more wiring layer.

The second antenna member 120*a* is electrically connected to the feed line 110*a* and configured to transmit/receive the RF signal. For example, the second antenna member 120*a* is disposed adjacent to side surfaces of the antenna module 70*a*, and has a folded dipole form. Here, a first end and a second end of the second antenna member 120*a* are electrically connected to first and second feed lines of the feed line 110*a*, respectively, and transmit/receive the RF signal in a differential feeding method.

The second antenna member 120*a* has a frequency band (e.g., 28 GHz) according to one or more of a pole length, a pole thickness, an interval between poles, an interval between a pole and a side surface of the connection member, and dielectric permittivity of the one or more insulating layer.

The second director member 125*a* is disposed spaced apart from the second antenna member 120*a* in a direction (the second direction D2) away from the center of the connection member 200*a*. The second director member 125*a* electromagnetically couples to the second antenna member 120*a* to improve a gain or a bandwidth of the second antenna member 120*a*. The second director member 125*a* has a length (e.g., 0.8 times of a dipole total length) shorter than a dipole total length of the second antenna member 120*a* and the second antenna member 120*a* increases the concentration of the electromagnetic coupling as the length of the second director member 125*a* decreases. Accordingly, directivity of the second antenna member 120*a* is further improved.

The second director member 125*a* has a structure in which an inside boundary 123*a* thereof toward the second antenna member 120*a* is oblique with respect to the second antenna member 120*a*. Accordingly, since a surface current flowing in the second antenna member 120*a* includes a component in a direction corresponding to the inside boundary, a bandwidth of the second antenna member 120*a* is increased and the radiation pattern formed by the second antenna member 120*a* has a wider distribution.

In addition, the bandwidth and the radiation pattern distribution of the second antenna member 120*a* can be varied depending on an angle of inclination of the inside boundary. The second director member 125*a* improves a degree of freedom of a design of the bandwidth and the radiation pattern distribution of the second antenna member 120*a*, and the second antenna member 120*a* has a more precisely adjusted antenna performance.

In addition, the second director member 125*a* is disposed to overlap the second antenna member 120*a* between a first pole and a second pole of the dipole when viewing the second antenna member 120*a* from the second direction D2. Accordingly, the second antenna member 120*a* further concentrates the electromagnetic coupling to the second director member 125*a*.

The antenna apparatus 100*a* according to the first embodiment further includes a second feed via 111*a* electrically connected between the feed line 110*a* and the second antenna member 120*a*. Due to the second feed via 111*a*, the second antenna member 120*a* may be disposed at a position higher or lower than the feed line 110*a*. Since a detailed position of the second antenna member 120*a* may be varied depending on a length of the second feed via 111*a*, a direction of the radiation pattern of the second antenna member 120*a* may be appropriately adjusted according to a predetermined length of the second feed via 111*a*.

Figure 2:
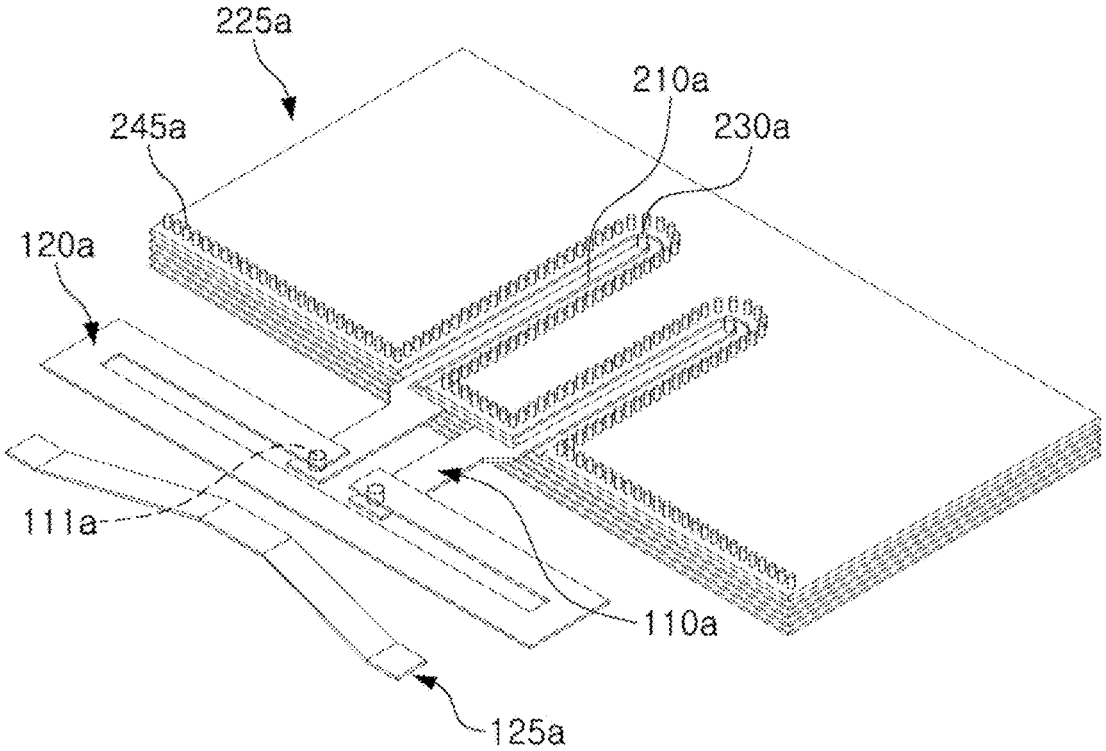
FIG. 2 is a view illustrating an example of an antenna module, an antenna apparatus, and a ground layer according to a second embodiment.

FIG. 2 is a view illustrating an example of an antenna module, an antenna apparatus, and a ground layer according to a second embodiment of the present disclosure.

Referring to FIG. 2, the connection member of the antenna module includes a ground layer 225*a* disposed on the same level as the feed line 110*a* and disposed to be spaced apart from the feed line 110*a*.

The ground layer 225*a* acts as a reflector with respect to the second antenna member 120*a*. That is, the ground layer 225*a* assists antenna performance (e.g., a transmission/reception rate, a gain, a bandwidth, directivity, and the like) of the second antenna member 120*a*.

Referring to FIG. 2, the connection member of the antenna module further includes shielding vias 245*a* disposed in parallel adjacent to a boundary of the ground layer 225*a*.

The shielding vias 245*a* reduce transmission loss of the RF signal of a wiring layer 210*a* of the one or more wiring layer of the connection member, act as reflectors with respect to the second antenna member 120*a*, and improve isolation of the second antenna member 120*a* relative to the wiring layer 210*a*.

The wiring layer 210*a* is electrically connected to a wiring via 230*a* to be thereby electrically connected to the IC. The wiring layer 210*a* is integrated into the feed line 110*a*. Here, the ground layer 225*a* is disposed to surround at least a portion of the feed line 110*a*.

Figure 3:
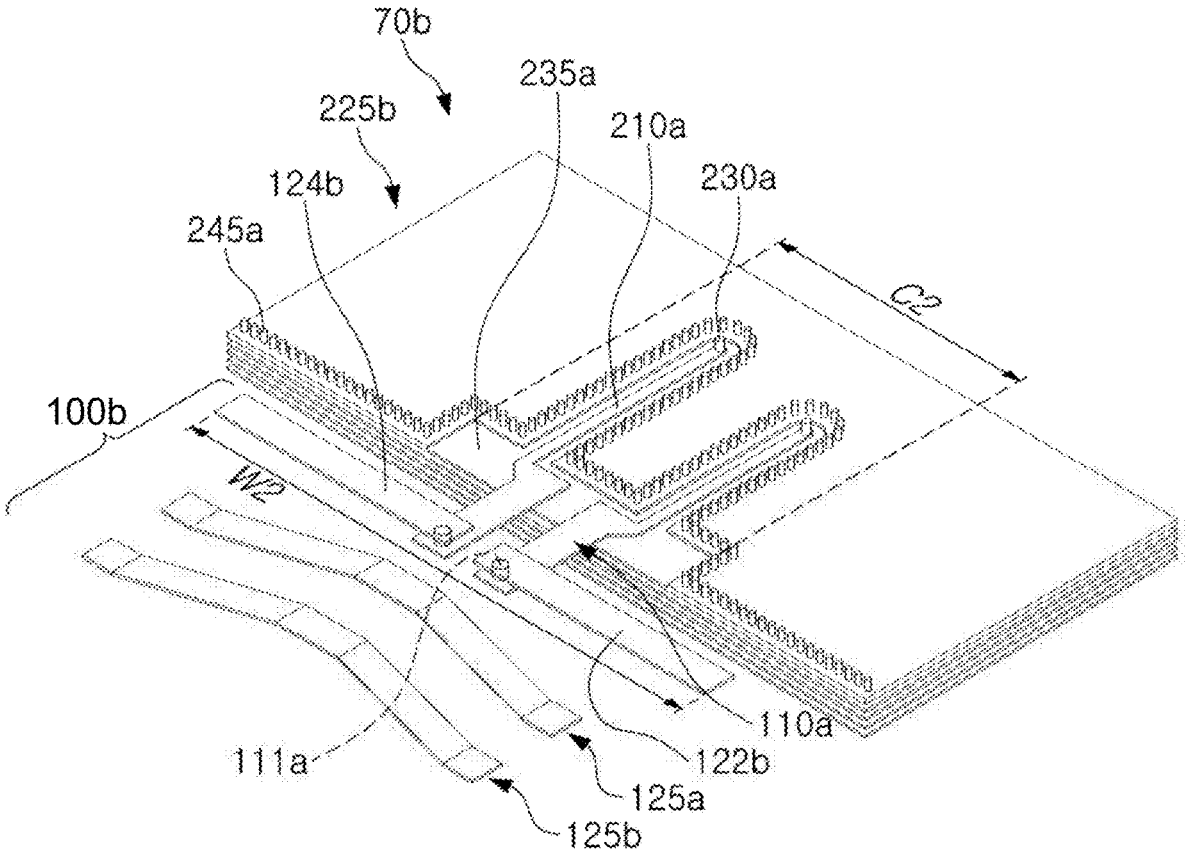
FIG. 3 is a view illustrating an example of an antenna module and an antenna apparatus according to a third embodiment.

FIG. 3 is a view illustrating an example of an antenna module 70*b* and an antenna apparatus 100*b* according to a third embodiment of the present disclosure.

A distance from a boundary of a ground layer 225*b* to a second antenna member 120*b* influences antenna performance of the second antenna member 120*b*. In order to satisfy antenna performance required for a predetermined design, the second antenna member 120*b* is spaced apart from the ground layer 225*b* by a distance greater than a predetermined length.

Referring to FIG. 3, the boundary of the ground layer 225*b* on a side facing the second antenna member 120*b* is closer to the center of the connection member. For example, a partial region 235*a* of the ground layer 225*b* is disposed so that the boundary of the ground layer 225*b* has a concave shape.

Accordingly, a range of the distance from the boundary of the ground layer 225*b* to the second antenna member 120*b* is increased, and the second antenna member 120*b* is disposed closer to the center of the connection member without substantially sacrificing antenna performance.

A width C2 of the partial region 235*a* may be greater than the dipole total length W2 of the second antenna member 120*b*. For example, the partial region 235*a* width C2 is 1.7 times the dipole total length W2. Accordingly, the second antenna member 120*b* further concentrates the electromagnetic coupling to the second director member 125*a*, 125*b*.

In addition, the antenna apparatus 100*b* according to the third embodiment of the present disclosure further includes an additional second director member 125*b* spaced apart from the second director member 125*a* so as to correspond to the second director member 125*a*. In such a case in which the number of second director members is increased, the second antenna performance such as the bandwidth of the second antenna member 120*b* may be improved.

Referring to FIG. 3, the second antenna member 120*b* has a dipole form including two poles 122*b*, 124*b*. A detailed form of the second antenna member 120*b* may be varied depending on predetermined design factors including, for example, a detailed wiring layout of the connection member, whether an IC package is applied, characteristics of the second antenna member, frequency characteristics of the RF signal, a process of manufacturing an antenna module, an entire size of the antenna module, a manufacturing cost of the antenna module, and the like.

Figure 4A:
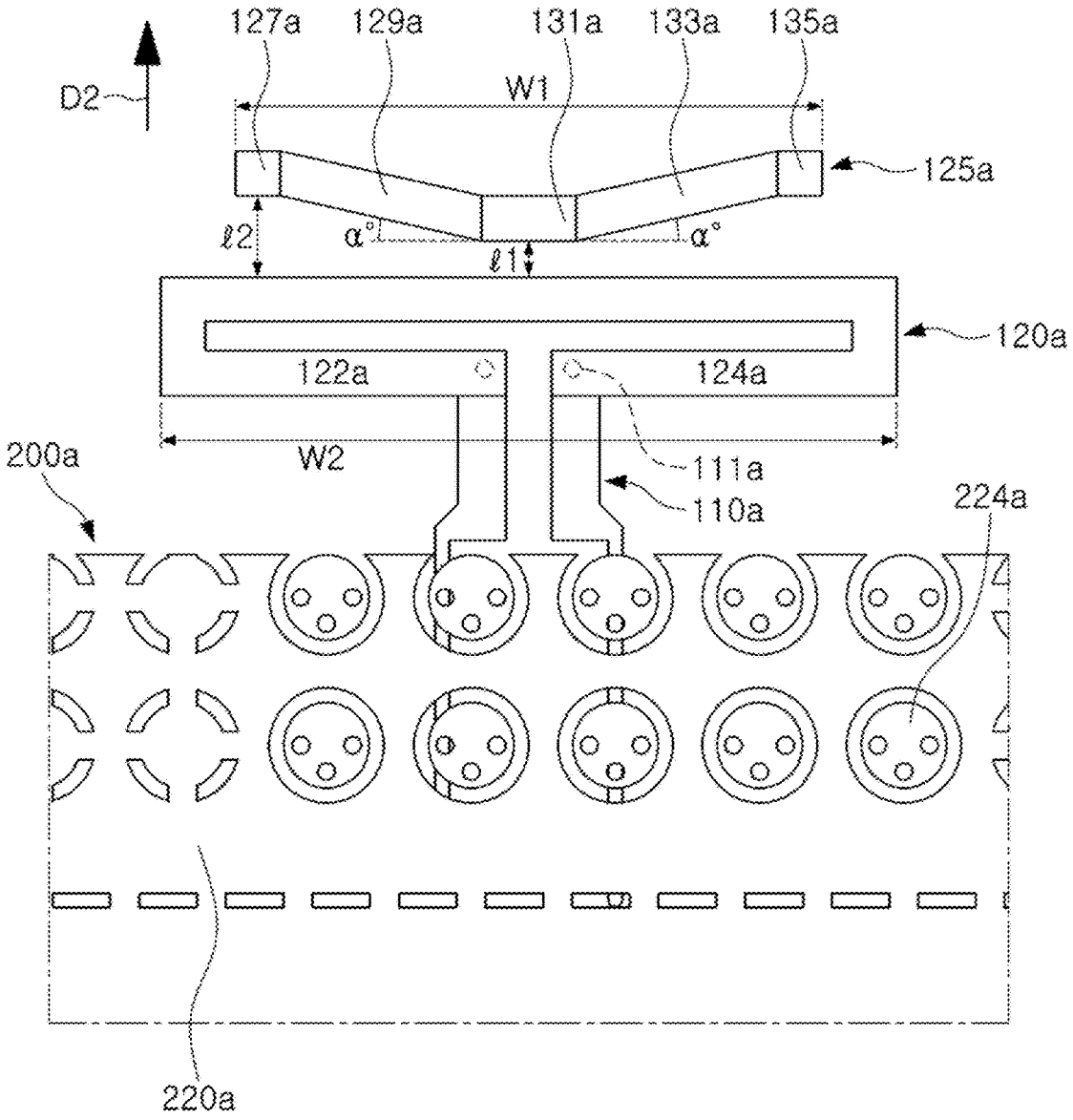
FIG. 4A is a view illustrating an example of spaced distances, lengths, and angles of the antenna module and the antenna apparatus of the first embodiment.

FIG. 4A is a view illustrating an example of spaced distances, lengths, and angles of the antenna module 70*a* and the antenna apparatus 100*a* according to the first embodiment.

Referring to FIG. 4A, the second director member 125*a* has a structure in which an inside boundary thereof is oblique so that a spaced distance 12 between ends of the second director member 125*a* and the second antenna member 120*a* is greater than a spaced distance 11 between the center of the second director member 125*a* and the second antenna member 120*a*. Accordingly, the bandwidth of the second antenna member 120*a* is increased, and the radiation pattern formed by the second antenna member 120*a* has a wider distribution.

Referring to FIG. 4A, the second director member 125*a* has a length W1 which is longer than a length (a half of W2) of the first pole 122*a*, is longer than a length (a half of W2) of the second pole 124*a*, and is shorter than a unified length W2 of the first pole 122*a* and the second pole 124*a* when viewing the second antenna member 120*a* from the first direction D1 (FIG. 4A plan view). Accordingly, the second antenna member 120*a* concentrates the electromagnetic coupling to the second director member 125*a* and effectively receives an influence due to the oblique boundary of the second director member 125*a*.

Referring to FIG. 4A, the second director member 125*a* has a structure in which a first portion 127*a* is parallel to the first pole 122*a* and the second pole 124*a* of the second antenna member 120*a*, a second portion 129*a* oblique to the first pole 122*a* and the second pole 124*a*, a third portion 131*a* parallel to the first pole 122*a* and the second pole 124*a*, a fourth portion 133*a* oblique to the first pole 122*a* and the second pole 124*a*, and a fifth portion 135*a* parallel to the first pole 122*a* and the second pole 124*a*, where the first portion 127*a* through the fifth portion 135*a* are sequentially connected to each other. Accordingly, the second antenna member 120*a* concentrates the electromagnetic coupling to the second director member 125*a* and effectively receives an influence due to the oblique boundary of the second director member 125*a*.

Referring to FIG. 4A, an angle of the oblique boundary a in the second director member 125*a* is in a range of 5° or more to 14° or less, but is not limited thereto.

Figure 4B:
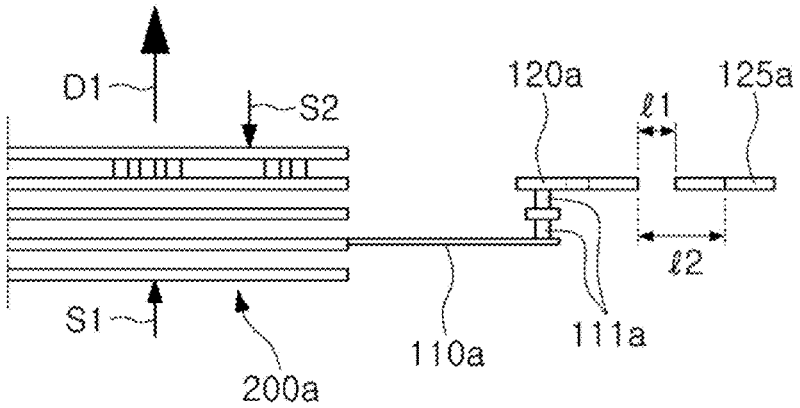
FIG. 4B is a view illustrating example side surfaces of the antenna module and the antenna apparatus illustrated in FIG. 4A.

FIG. 4B is a view illustrating example side surfaces of the antenna module and the antenna apparatus illustrated in FIG. 4A.

Referring to FIG. 4B, one end of the feed line 110*a* is connected to the connection member 200*a*, and the other end of the feed line 110*d* is connected to the second feed via 111*a*. Accordingly, the second antenna member 120*a* is disposed on a higher layer than the feed line 110*a*. In addition, the second director member 125*a* is disposed on the same level as the second antenna member 120*a*.

Figure 5A:
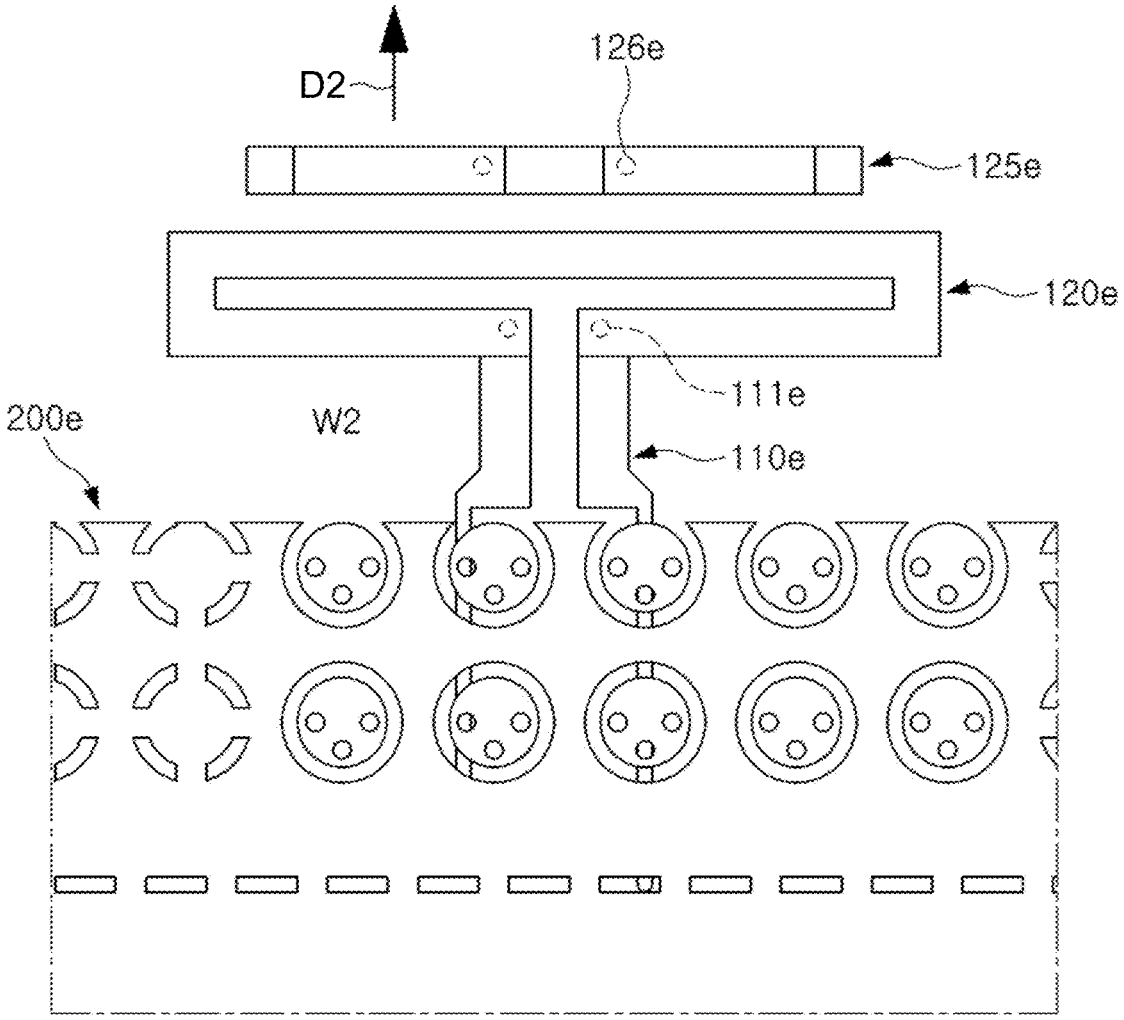
FIG. 5A is a view illustrating an example of an antenna module, an antenna apparatus, and a director via according to a fourth embodiment.

FIG. 5A is a view illustrating an example antenna module, an antenna apparatus, and a director via according to a fourth embodiment of the present disclosure.

Referring to FIG. 5A, the antenna apparatus further includes one or more director via 126*e* connected to a second director member 125*e* so that an inside boundary of the second director member 125*e* extends oblique in the first direction D1 relative to the second antenna member 120*e*. That is, the ends of the second director member 125*e* are disposed on a higher layer than the center of the second director member 125*e*. Accordingly, a bandwidth of the second antenna member 120*e* is increased, and a radiation pattern formed by the second antenna member 120*e* has a wider distribution.

Figure 5B:
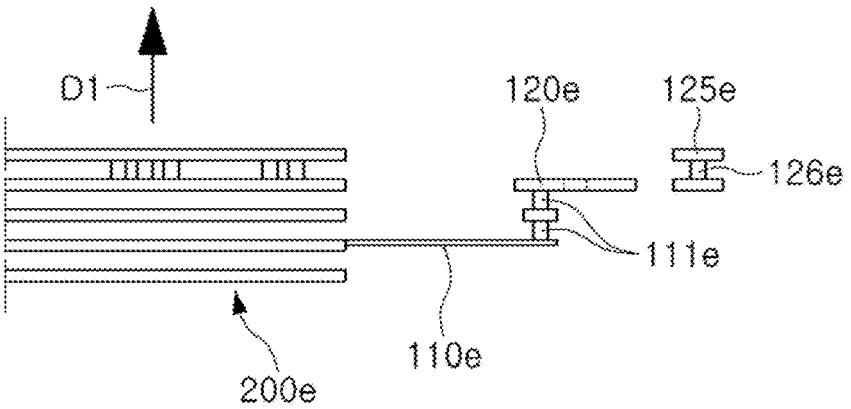
FIG. 5B is a view illustrating side surfaces of the antenna module and the antenna apparatus illustrated in FIG. 5A.

FIG. 5B is a view illustrating example side surfaces of the antenna module and the antenna apparatus illustrated in FIG. 5A.

Referring to FIG. 5B, one end of a feed line 110*e* is connected to a connection member 200*e*, and the other end of the feed line 110*e* is connected to a second feed via 111*e*. Accordingly, the second antenna member 120*e* is disposed on a higher layer than the feed line 110*e*. In addition, the second director member 125*e* is disposed to extend from the same level as the second antenna member 120*e* to a higher layer than the second antenna member 120*e* through a director via 126*e*.

FIGS. 6A through 6F are views illustrating examples of various forms of second directors of an antenna module and an antenna apparatus according to fifth through tenth embodiments of the present disclosure.

Figure 6A:
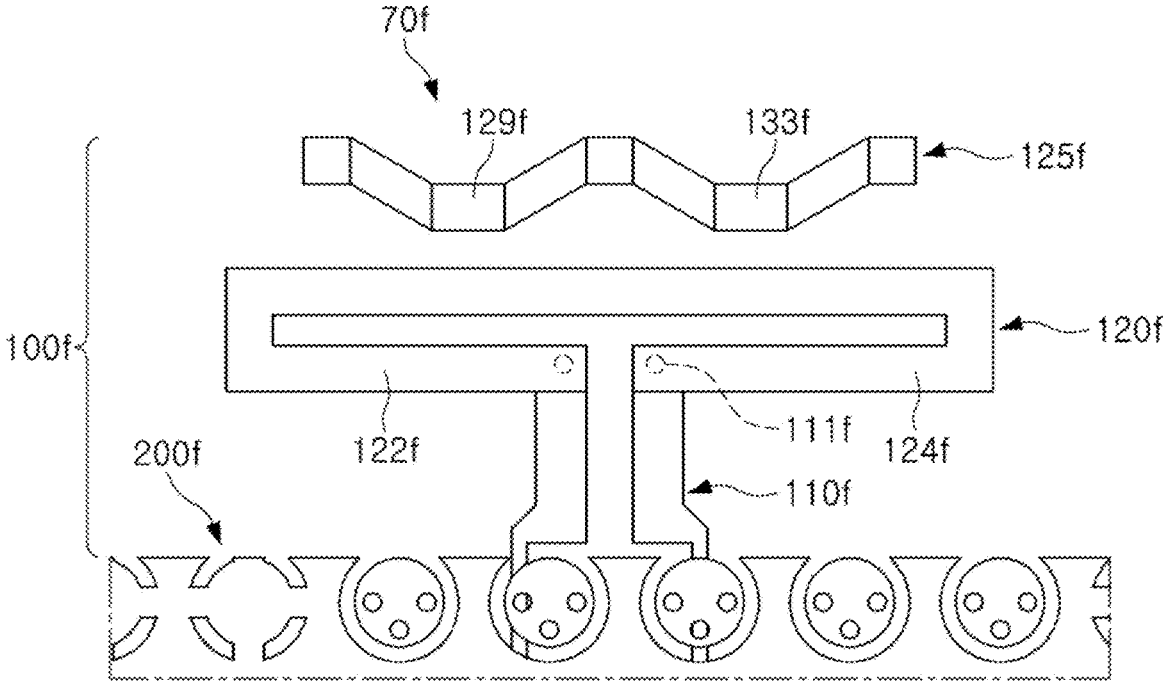
FIGS. 6A through 6F are views illustrating examples of various forms of directors of an antenna module and an antenna apparatus according to fifth through tenth embodiments.

Referring to FIG. 6A, an example of the antenna module 70*f* and the antenna apparatus 100*f* according to the fifth embodiment of the present disclosure includes at least portions of a feed line 110*f*, a second feed via 111*f*, a second antenna member 120*f*, a second director member 125*f*, and a connection member 200*f*. Here, the second director member 125*f* simultaneously has a first portion 129*f* protruding to a first pole 122*f* of the second antenna member 120*f* and a second portion 133*f* protruding to a second pole 124*f* of the second antenna member 120*f*. Accordingly, directivity of the second antenna member 120*f* is improved.

Figure 6B:
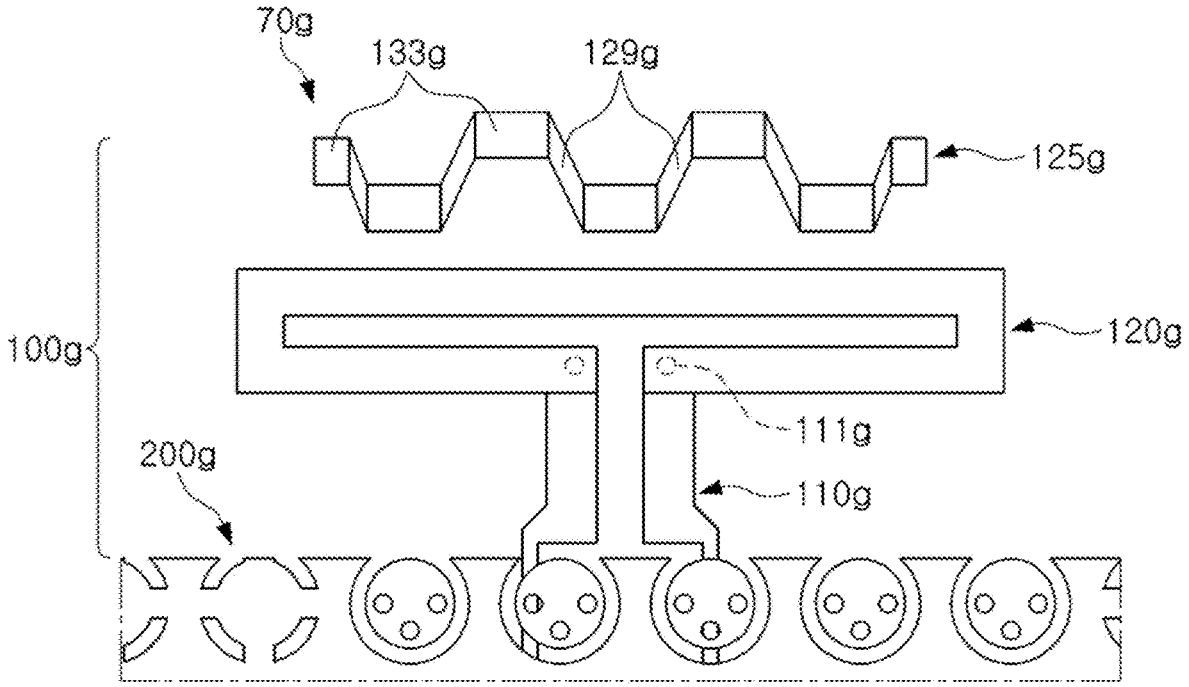

Referring to FIG. 6B, an example of the antenna module 70*g* and the antenna apparatus 100*g* according to the sixth embodiment of the present disclosure includes at least portions of a feed line 110*g*, a second feed via 111*g*, a second antenna member 120*g*, a second director member 125*g*, and a connection member 200*g*. Here, a thickness of a first portion 129*g* of the second director member 125*g* having an oblique inside boundary is less than a thickness of a second portion 133*g* of the second director member 125*g* having a parallel inside boundary. Accordingly, the second antenna member 120*g* effectively receives an influence due to the oblique boundary of the second director member 125*g*.

Figure 6C:
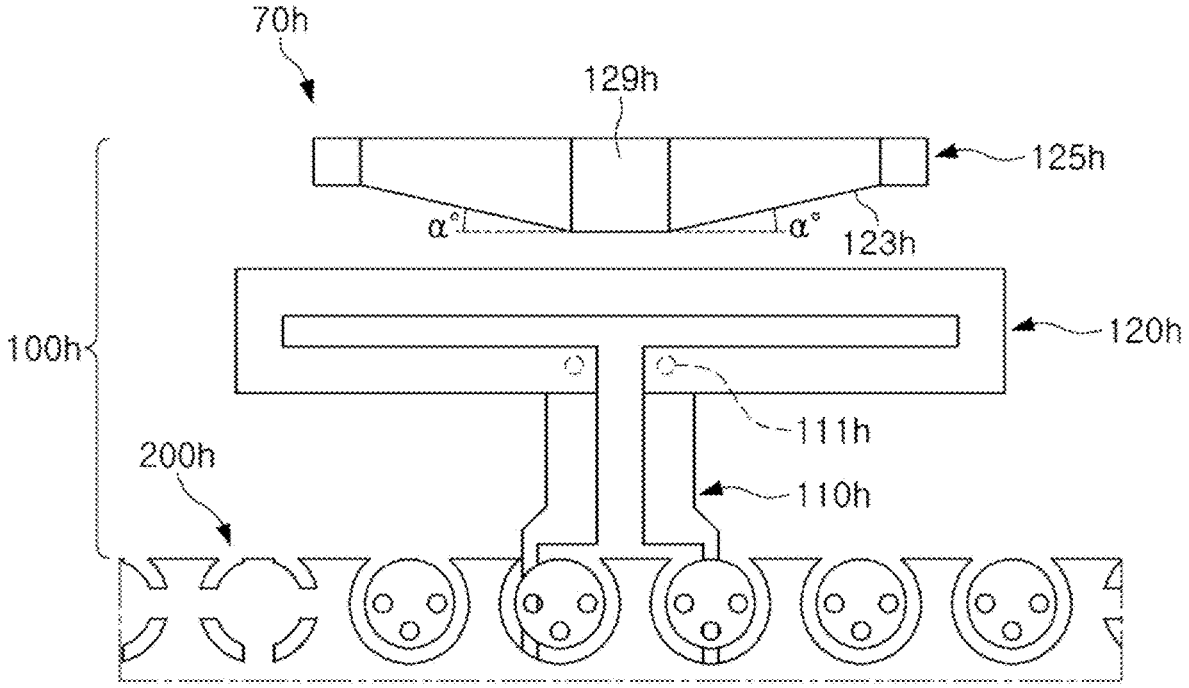

Referring to FIG. 6C, an example of the antenna module 70*h* and the antenna apparatus 100*h* according to the seventh embodiment of the present disclosure includes at least portions of a feed line 110*h*, a second feed via 111*h*, a second antenna member 120*h*, a second director member 125*h*, and a connection member 200*h*. Here, the second director member 125*h* has a structure in which the center 129*h* thereof protrudes to the second antenna member 120*h*. For example, the center 129*h* is wider than the ends of the second director member 125*h*. Accordingly, the second antenna member 120*h* effectively receives an influence due to the oblique boundary 123*h* of the second director member 125*h*.

Figure 6D:
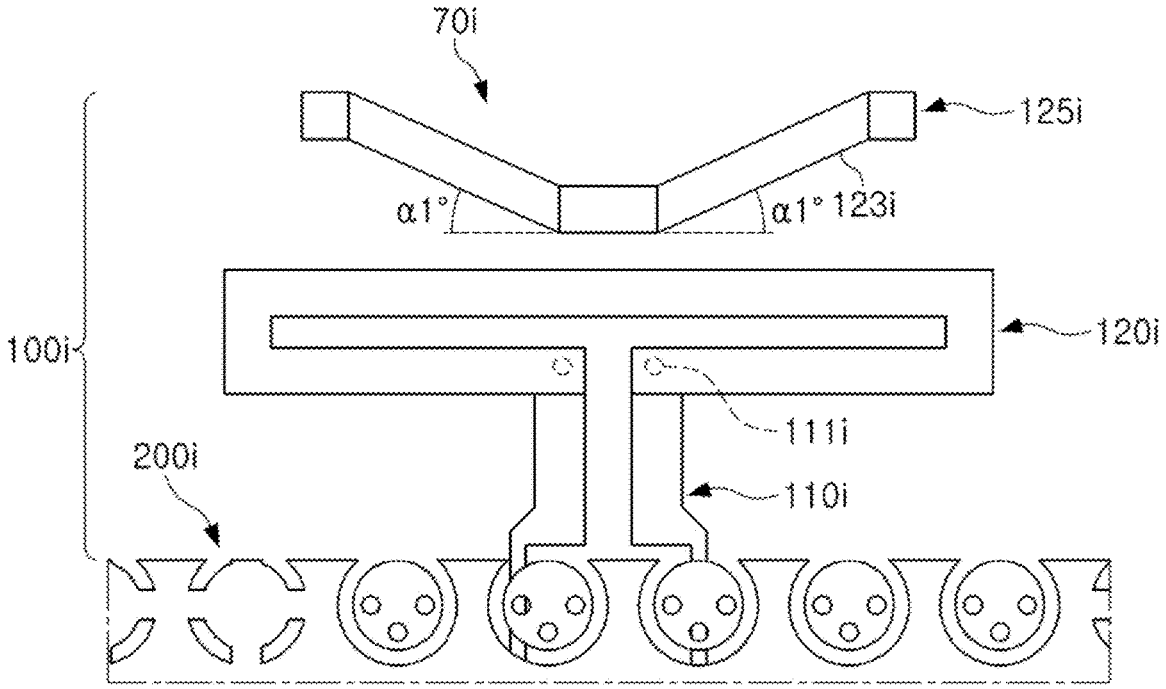

Referring to FIG. 6D, an example of the antenna module 70*i* and the antenna apparatus 100*i* according to the eighth embodiment of the present disclosure includes at least portions of a feed line 110*i*, a second feed via 111*i*, a second antenna member 120*i*, a second director member 125*i*, and a connection member 200*i*. Here, an angle α1 of an oblique boundary 123*i* of the second director member 125*i* is greater than 14°.

Figure 6E:
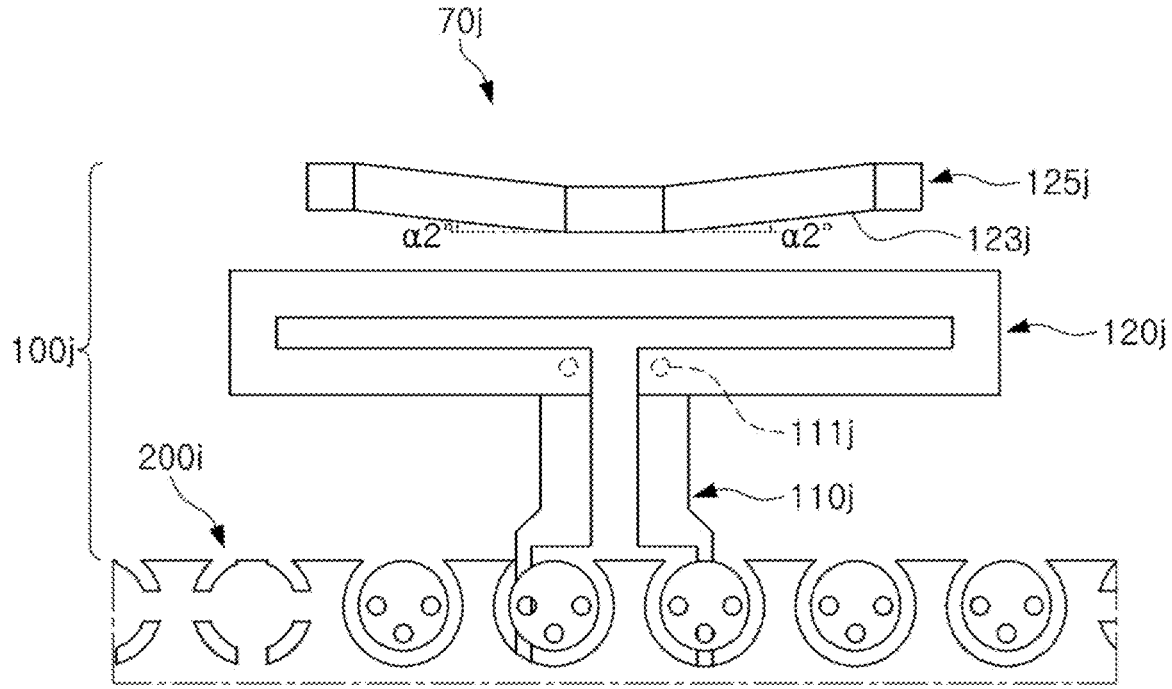

Referring to FIG. 6E, an example of the antenna module 70*j* and the antenna apparatus 100*j* according to the ninth embodiment of the present disclosure includes at least portions of a feed line 110*j*, a second feed via 111*j*, a second antenna member 120*j*, a second director member 125*j*, and a connection member 200*j*. Here, an angle α2 of an oblique boundary 123*j* of the second director member 125*j* is less than 5°.

Figure 6F:
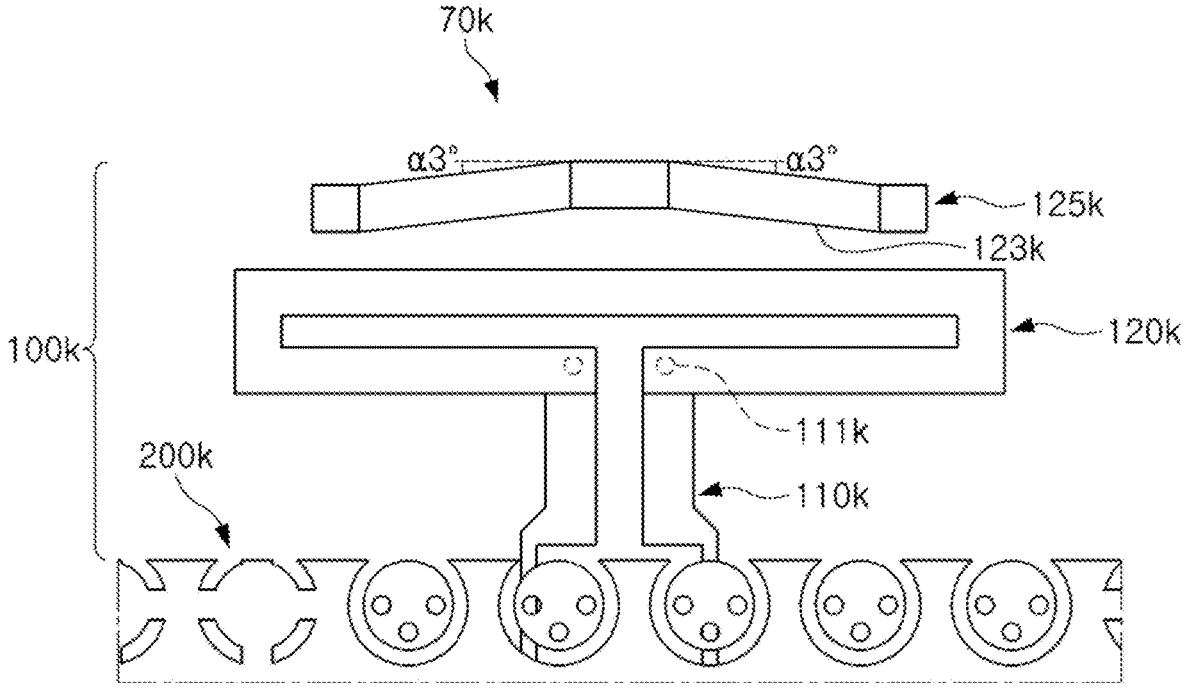

Referring to FIG. 6F, an example of the antenna module 70*k* and the antenna apparatus 100*k* according to the tenth embodiment of the present disclosure includes at least portions of a feed line 110*k*, a second feed via 111*k*, a second antenna member 120*k*, a second director member 125*k*, and a connection member 200*k*. Here, an angle α3 of an oblique boundary 123*k* in the second director member 125*k* is less than 0°.

A detailed form of the second director may be varied depending on predetermined design factors, including, for example, a detailed wiring layout of the connection member, whether an IC package is applied, characteristics of the second antenna member, frequency characteristics of the RF signal, a process of manufacturing an antenna module, an entire size of the antenna module, a manufacturing cost of the antenna module, and the like.

Figure 7:
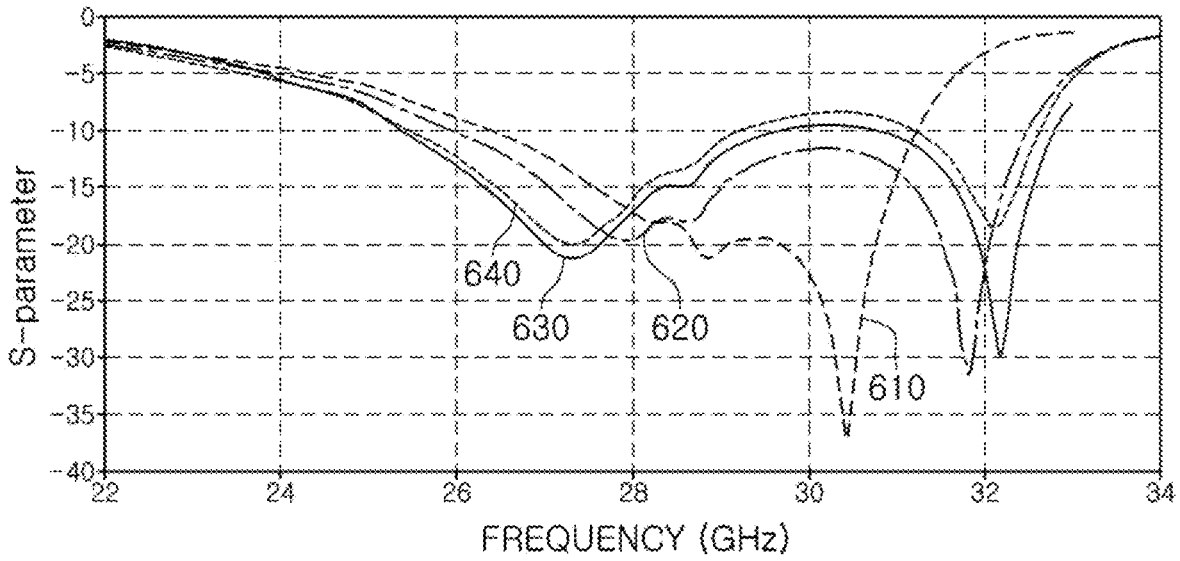
FIG. 7 is a view illustrating examples of S-parameters of the antenna module and the antenna apparatus according to the eleventh through fourteenth embodiments of the present disclosure.

FIG. 7 is a view illustrating S-parameters of example antenna module and antenna apparatus according to eleventh through fourteenth embodiments of the present disclosure. The S-parameter represents a ratio of energy reflected to a first port to energy incident from the first port.

Referring to FIG. 7, a bandwidth of an S-parameter 610 of a first case in which an angle of an oblique boundary in the second director member is 0° in the eleventh embodiment is narrower than a bandwidth of an S-parameter 620 of a second case in which the angle of the oblique boundary in the second director member is 5° in the twelfth embodiment, a bandwidth of an S-parameter 630 of a third case in which the angle of the oblique boundary in the second director member is 14° in the thirteenth embodiment, and a bandwidth of an S-parameter 640 of a fourth case in which the angle of the oblique boundary in the second director member is 24° in the fourteenth embodiment. That is, the example antenna module and antenna apparatus according to the twelfth through fourteenth embodiments of the present disclosure increase the bandwidth compared to the eleventh embodiment. However, even the example antenna module and antenna apparatus according to the eleventh embodiment of the present disclosure increases the bandwidth.

Referring to FIG. 7, a value (about −31 dB) at about 32 GHz of the S-parameter 620 of the second case and a value (about −30 dB) at about 32 GHz of the S-parameter 630 of the third case may be greatly lower than a value (about −18 dB) at about 32 GHz of the S-parameter 640 of the fourth case. That is, in a case in which the angle of the oblique boundary in the director member included in the antenna module and the antenna apparatus is set to greater than or equal to 5° and less than or equal to 14°, the antenna module and the antenna apparatus exhibited additional antenna performance. However, since the additional antenna performance may not be required in all embodiments, for example, depending on a predetermined design factor, the angle is not intended to be limited thereto.

Figure 8:
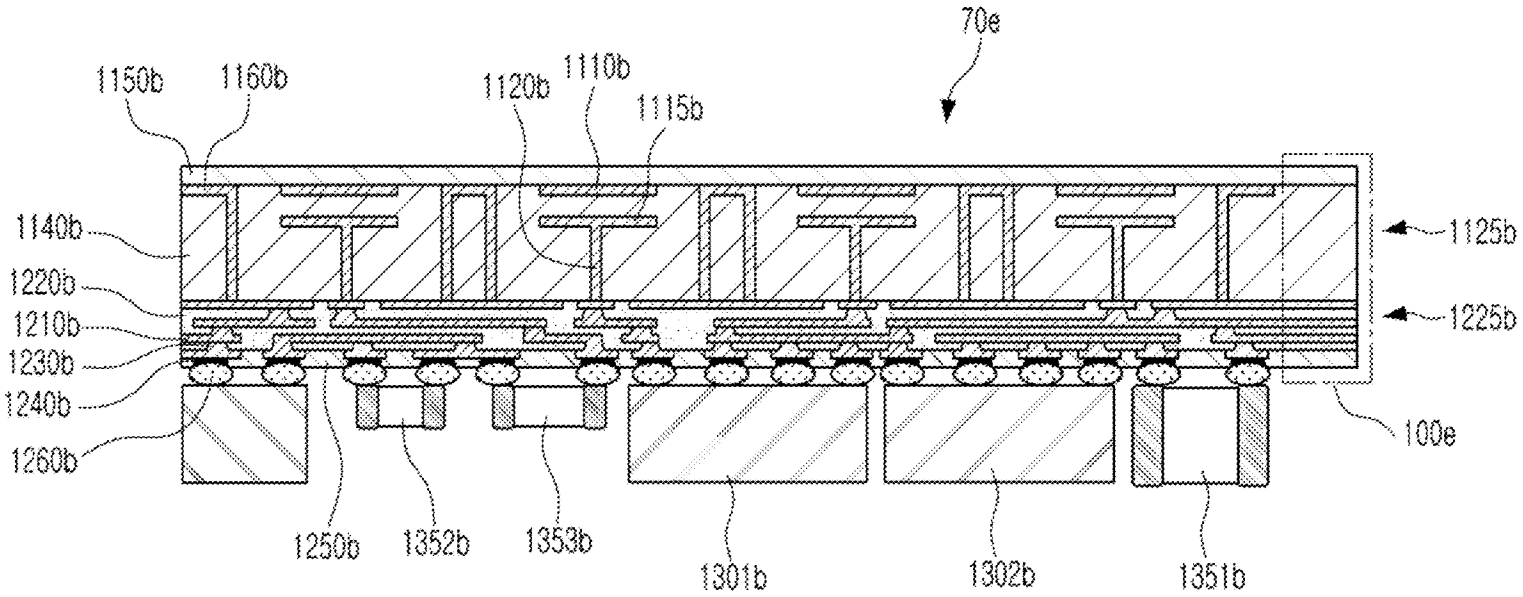
FIG. 8 is a view illustrating an example of an antenna module, an integrated circuit (IC), and an antenna package according to a fifteenth embodiment.

FIG. 8 is a view illustrating an example of an antenna module, an integrated circuit (IC), and an antenna package according to a fifteenth embodiment of the present disclosure.

Referring to FIG. 8, an example of an antenna module 70*e* according to the fifteenth embodiment of the present disclosure has a heterogeneous structure in which an antenna package 1125*b* and a connection member 1225*b* are coupled to each other. That is, the antenna module 70*e* may be miniaturized while improving antenna performance, including, for example, a transmission/reception rate, a gain, directivity, and the like, by utilizing both characteristics that facilitate improvement in the antenna performance of the antenna package 1125*b* and characteristics that facilitate disposal of a circuit pattern and/or an integrated circuit (IC) on or in the connection member 1225*b*.

The connection member 1225*b* includes one or more wiring layer 1210*b* and one or more insulating layer 1220*b*. The connection member 1225*b* includes a wiring via 1230*b* connected to one or more wiring layer 1210*b* and a connection pad 1240*b* connected to the wiring via 1230*b*, and may have a structure similar to a copper redistribution layer (RDL). A passivation layer 1250*b* is disposed on lower surface of the connection member 1225*b* exposing the connection pad 1240*b*. The antenna package 1125*b* is disposed on an upper surface of the connection member 1225*b*.

The antenna package includes at least portions of first director members 1110*b*, first antenna members 1115*b*, first feed vias 1120*b*, a dielectric layer 1140*b*, an encapsulation member 1150*b*, and a plating member 1160*b*.

The first director members 1110*b* are disposed adjacent to one surface (an upper surface of FIG. 8) of the antenna module 1125*b*, and transmit/receive an RF signal generated by an IC 1301*b* together with the first antenna members 1115*b* disposed at a lower end of respective first director members 1110*b*.

Depending on a predetermined design, the first director members 1110*b* may be omitted, or one or more additional first director member may be further disposed on respective first director members 1110*b*.

The first antenna members 1115*b* can be electromagnetically coupled to respective first director members 1110*b* disposed at an upper end thereof, and can receive the RF signal and/or transmit the RF signal generated by the IC 1301*b* together with a corresponding first director member 1110*b*. For example, the first antenna members 1115*b* have a shape (e.g., a patch antenna, or the like) similar to that of the corresponding first director member 1110*b*.

The first feed vias 1120*b* are electrically connected to respective first antenna members 1115*b* to provide a path of the RF signal. The first feed vias 1120*b* extend up to a length longer than a thickness of one or more insulating layer 1220*b* of the connection member 1225*b*. Accordingly, transmission efficiency of the RF signal is improved.

The dielectric layer 1140*b* is disposed to surround a side surface of each of the first feed vias 1120*b*. The dielectric layer 1140*b* has a height greater than that of the one or more insulating layer 1220*b* of the connection member 1225*b*. The antenna package 1125*b* provides improved antenna performance as a height and/or width of the dielectric layer 1140*b* is increased, and provides boundary conditions (e.g., a small manufacturing tolerance, a short electrical length, a smooth surface, a large size of the dielectric layer, an adjustment of a dielectric constant, structurally securing the antenna package 1125*b* elements, and the like), and greater transmission/reception operation of RF signal of the first antenna members 1115*b*.

For example, the dielectric layer 1140*b* and at least one of the one or more insulating layer 1220*b* may be formed of a thermosetting resin such as an epoxy resin, a thermoplastic resin such as a polyimide resin, a resin in which the thermosetting resin or the thermoplastic resin is impregnated together with an inorganic filler in a core material such as a glass fiber (or a glass cloth or a glass fabric), for example, prepreg, Ajinomoto Build up Film (ABF) (AJINOMOTO FINE-TECHNO CO., INC.), FR-4, Bismaleimide Triazine (BT), a photo imagable dielectric (PID) resin, generic copper clad laminate (CCL), a glass based material, a ceramic based material, or a combination thereof.

The dielectric layer 1140*b* has a dielectric constant greater than a dielectric constant Dk of the one or more insulating layer 1220*b*. For example, the dielectric layer 1140*b* may be formed of glass, ceramic, or silicon having a large dielectric constant (e.g., 5 or more), and the one or more insulating layer 1220*b* may be formed of copper clad laminate (CCL) or prepreg having a relatively lower dielectric constant.

The encapsulation member 1150*b* is disposed on the dielectric layer 1140*b*, and improves durability against impact or oxidation of the first antenna members 1115*b* and the first director members 1110*b*. For example, the encapsulation member 1150*b* may be formed of a photo imageable encapsulant (PIE), Ajinomoto build-up film (ABF) (AJINOMOTO FINE-TECHNO CO., INC.), epoxy molding compound (EMC), and the like, or combinations thereof, but is not limited thereto.

The plating member 1160*b* is disposed in the dielectric layer 1140*b* to surround each of a side surface of each of the first feed vias 1120*b*. That is, the plating member 1160*b* forms cavities corresponding to each of the first antenna members 1115*b* to provide a boundary condition for transmission/reception of the RF signal of the corresponding first antenna member 1115*b*.

An IC 1301*b*, a PMIC 1302*b*, and passive components 1351*b*, 1352*b*, and 1353*b* are disposed on a lower surface of the connection member 1225*b*. The IC 1301*b*, a PMIC 1302*b*, and passive components 1351*b*, 1352*b*, and 1353*b* may be coupled to the connection member 1225*b* through an electrical connection structure 1260*b* and the passivation layer 1250*b* or the electrical connection structure 1260*b* and the passivation layer 1250*b* may be omitted depending on a predetermined design.

The IC 1301*b* generates an RF signal transmitted to the first antennal members 1115*b* and/or receives an RF signal from the first antenna members 1115*b*.

The PMIC 1302*b* generates power and transmits the generated power to the IC 1301*b* through at least one wire of the one or more wiring layer 1210*b* of the connection member 1225*b*.

The passive components 1351*b*, 1352*b*, and 1353*b* provide impedance to the IC 1301*b* and/or the PMIC 1302*b*. For example, the passive components 1351*b*, 1352*b*, and 1353*b* include at least a portion of a capacitor (e.g., a multilayer ceramic capacitor (MLCC)), an inductor, or a chip resistor.

The connection member 1225*b* includes the antenna apparatus 100*e* described above, for example, in the first through fourteenth embodiments with reference to FIGS. 1 through 7.

Meanwhile, depending on a predetermined design, the antenna package 1125*b* may be implemented to be homogeneous with the connection member 1225*b*. For example, the antenna package 1125*b* includes of the first antenna members 1115*b* each implemented through a ground pattern, and first feed vias 1120*b* implemented to each have a structure in which the first feed vias 1120*b* are connected to each other. Whether the antenna package 1125*b* is homogeneous/heterogeneous with the connection member 1225*b* is determined by the characteristics of the dielectric layer 1140*b*.

Figure 9:
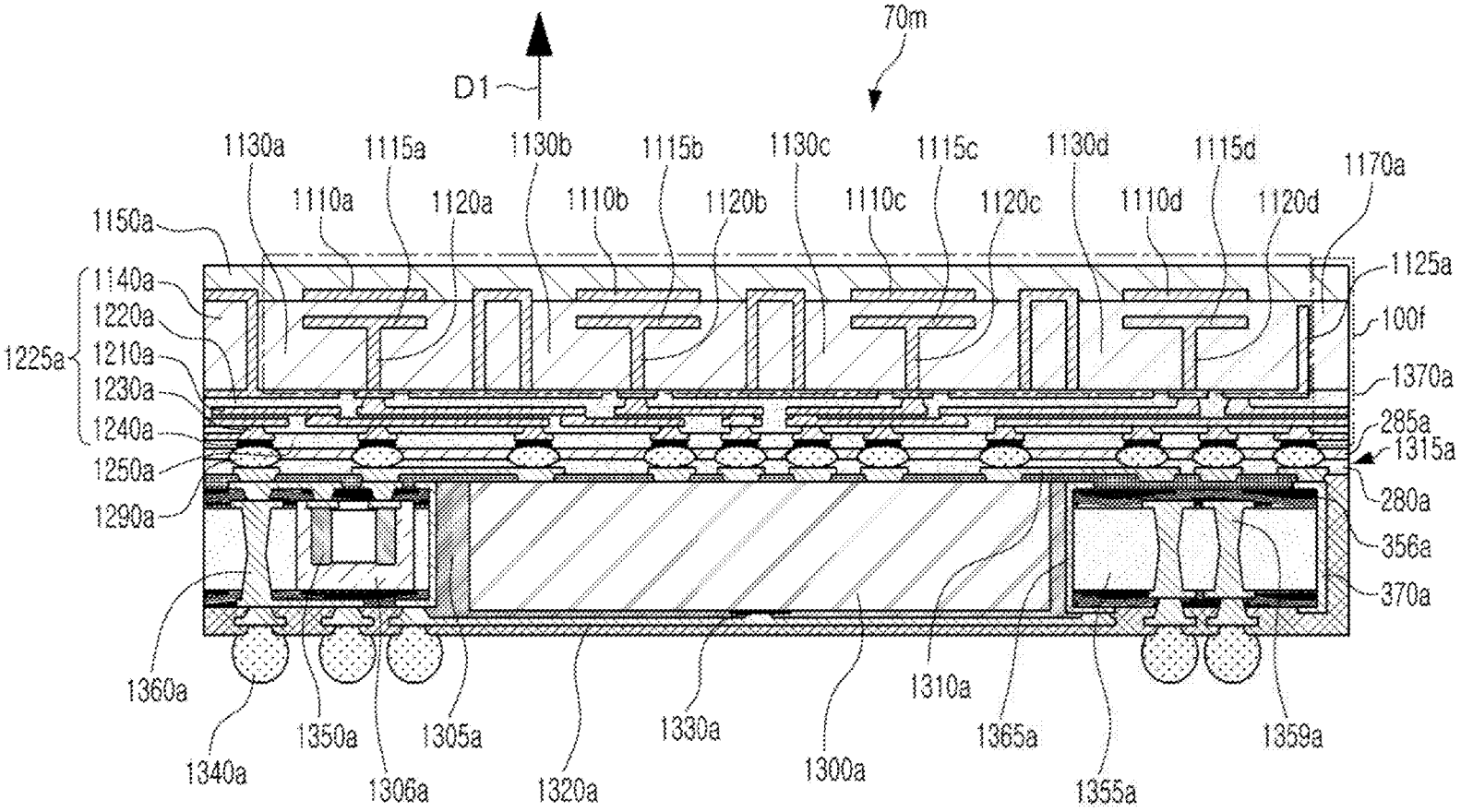
FIG. 9 is a view illustrating an example of an antenna module and an IC package according to a sixteenth embodiment.

FIG. 9 is a view illustrating an example of an antenna module and an IC package according to a sixteenth embodiment of the present disclosure.

Referring to FIG. 9, an IC package includes an IC 1300*a*, an encapsulant 1305*a* encapsulating at least a portion of the IC 1300*a*, a core member 1355*a* disposed so that a first side surface thereof faces the IC 1300*a*, and a first connection member 1315*a* including one or more first wiring layer 1310*a* and one or more first insulating layer 280*a* electrically connected to the IC 1300*a* and the core member 1355*a*, and coupled to a second connection member 1225*a* or an antenna package 1125*a*.

The second connection member 1225*a* includes one or more second wiring layer 1210*a*, one or more second insulating layer 1220*a*, a wiring via 1230*a*, a connection pad 1240*a*, and a passivation layer 1250*a*. The antenna package 1125*a* includes first director members 1110*a*, 1110*b*, 1110*c*, and 1110*d*, first antenna members 1115*a*, 1115*b*, 1115*c*, and 1115*d*, first feed vias 1120*a*, 1120*b*, 1120*c*, and 1120*d*, cavities 1130*a*, 1130*b*, 1130*c*, and 1130*d*, a dielectric layer 1140*a*, an encapsulation member 1150*a*, and a plating member 1170*a*.

The IC package is coupled to the first connection member 1315*a* described above. A first RF signal generated from the IC 1300*a* included in the IC package can be transmitted to the antenna package 1125*a* through at least one wire of the one or more first wiring layer 1310*a* and can be transmitted in an upper surface direction (first direction D1) of the antenna module 70*m*, and a first RF signal received by the antenna package 70*m* can be transmitted to the IC 1300*a* through at least one wire of the one or more first wiring layer 1310*a*.

The IC package further includes connection pads 1330*a* disposed on an upper surface and/or a lower surface of the IC 1300*a*. The connection pad 1330*a* disposed on the upper surface of the IC 1300*a* is electrically connected to at least one wire of the one or more first wiring layer 1310*a*, and the connection pad 1330*a* disposed on the lower surface of the IC 1300*a* is electrically connected to the core member 1355*a* or the core plating member 1365*a* through a lower end wiring layer 1320*a*. The core plating member 1365*a* provides a ground region to the IC 1300*a*.

The core member 1355*a* includes a core dielectric layer 356*a* in contact with the first connection member 1315*a*, core wiring layers 1359*a* disposed on an upper surface and/or a lower surface of the core dielectric layer 356*a*, and at least one core via 1360*a* penetrating through the core dielectric layer 356*a*, electrically connecting the core wiring layers 1359*a*, and electrically connected to the connection pads 1330*a*. One or more core via 1360*a* is electrically connected to an electrical connection structure 1340*a* such as a solder ball, a pin, and a land.

Accordingly, the core member 1355*a* receives a base signal or power from a lower surface thereof and transmits the base signal and/or power to the IC 1300*a* through the one or more first wiring layer 1310*a* of the first connection member 1315*a*.

The IC 1300*a* generates an RF signal of a millimeter wave (mmWave) band using the base signal and/or power. For example, the IC 1300*a* receives a base signal of a low frequency and performs a frequency conversion, amplification, a filtering phase control, and a power generation of the base signal, and may be formed of a compound semiconductor (e.g., GaAs) or a silicon semiconductor in consideration of high frequency characteristics.

The IC package further includes a passive component 1350*a* electrically connected to a corresponding wire of the one or more first wiring layer 1310*a*. The passive component 1350*a* is disposed in an accommodation space 1306*a* provided by the core member 1355*a* and provides impedance to the IC 1300*a* and/or one or more second directional antennal member 1370*a*. For example, the passive component 1350*a* includes at least a portion of a multilayer ceramic capacitor (MLCC), an inductor, or a chip resistor.

The IC package includes core plating members 1365*a* and 370*a* disposed on side surfaces of the core member 1355*a*.

The core plating members 1365*a* and 370*a* can provide a ground region to the IC 1300*a*, radiate heat of the IC 1300*a* to the outside, and remove noise of the IC 1300*a*.

The IC package and the antenna package 1125*a* may be manufactured and coupled independently of each other or may be manufactured together depending on a predetermined design. That is, a separate coupling process between two or more packages may be omitted.

The IC package may be coupled to the second connection member 1225*a* through the electrical connection structure 1290*a* and the passivation layer 285*a* or the electrical connection structure 1290*a* and the passivation layer 285*a* may be omitted depending on a predetermined design.

The second connection member 1225*a* may include the antenna apparatus 100*f* described above, for example, in the first through fourteenth embodiments with reference to FIGS. 1 through 7. For example, the antenna apparatus 100*f* includes a feed line 110*a*, a second antenna member 120*a*, and a second director member 125*a* (FIG. 1).

Figure 10:
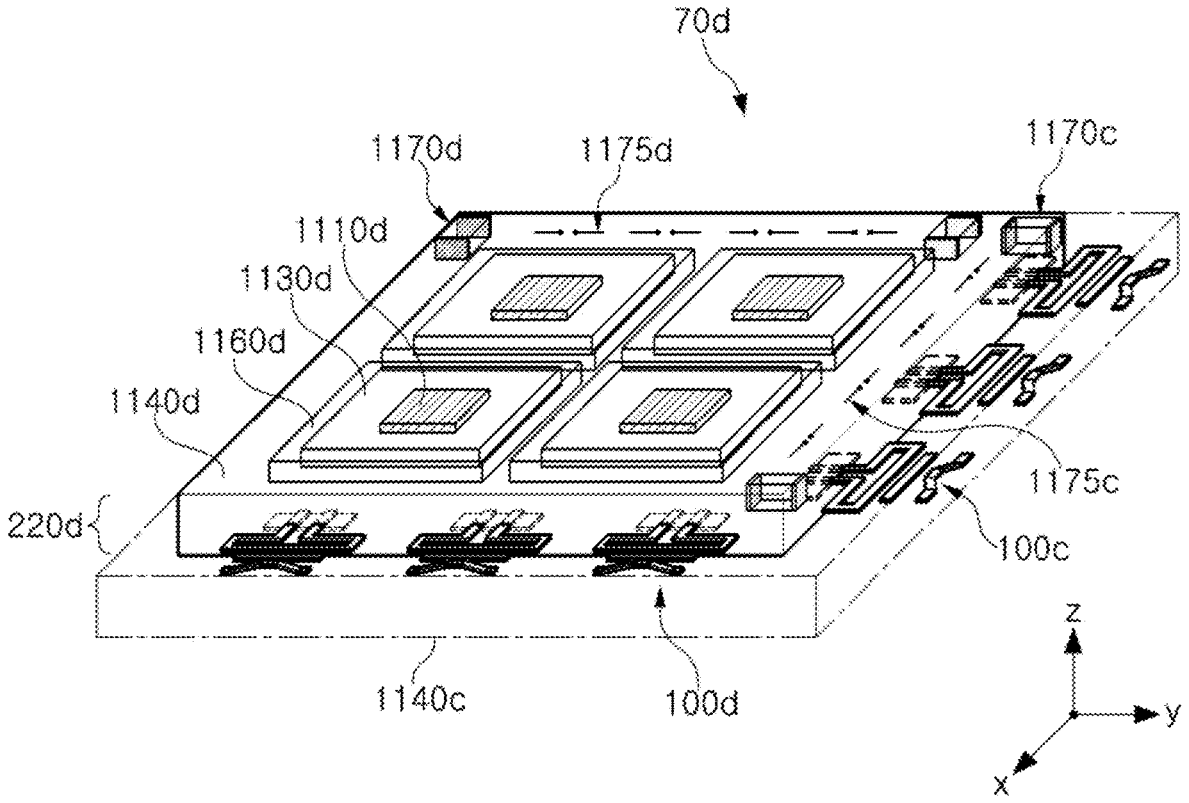
FIG. 10 is a view illustrating an example of layout positions of an antenna module and an antenna apparatus according to a seventeenth embodiment.

FIG. 10 is a view illustrating an example of layout positions of an antenna module and an antenna apparatus according to a seventeenth embodiment of the present disclosure.

Referring to FIG. 10, an antenna module 70*d* according to the seventeenth embodiment of the present disclosure includes one or more first director members 1110*d*, a cavity 1130*d*, a dielectric layer 1140*d*, a plating member 1160*d*, one or more first chip antennas 1170*c* and 1170*d*, and one or more first dipole antennas 1175*c* and 1175*d*.

The one or more first director members 1110*d* transmit/receive an RF signal in a z axis direction (first direction D1) together with a corresponding first antenna member. The number, layout, and shape of the one or more first director members 1110*d* and the first antenna members disposed at a lower end of each thereof are not particularly limited. For example, the shape of the one or more first director members 1110*d* may be a circular shape, and the number of the one or more first director members 1110*d* may be two or more.

The one or more chip antennas 1170*c* and 1170*d* are disposed to be adjacent to an edge of the antenna package and stood up in a z axis direction. One of the plurality of chip antennas 1170*c* and 1175*d* is configured to transmit/receive the RF signal in an x axis direction and the other thereof is configured to transmit/receive the RF signal in a y axis direction. Since the one or more chip antennas 1170*c* and 1170*d* are disposed in the antenna package 220*d*, the antenna module 70*d* significantly reduces a problem of a size increase due to an increase in the number of first chip antennas 1170*c* and 1170*d*.

The first dipole antennas 1175*c* and 1175*d* are disposed between the first dielectric layer 1140*d* and an encapsulation member to be adjacent to the edge of the antenna package. A first portion of the first dipole antennas 1175*d* is configured to transmit/receive a RF signal in the x axis direction and a second portion of the first dipole antennas 1175*c* is configured to transmit/receive a RF signal in the y axis direction. Depending on a predetermined design, one or more of the first dipole antennas 1175*c* and 1175*d* may be replaced with a respective monopole antenna.

In addition, the antenna module 70*d* includes one or more antenna apparatuses 100*c* and 100*d* described above, for example, in the first through fourteenth embodiments with reference to FIGS. 1 through 7. A first portion of the one or more antenna apparatuses 100*d* are configured to transmit/receive a RF signal in the x axis direction and a second portion of the one or more antenna apparatuses 100*c* are configured to transmit/receive a RF signal in the y axis direction.

In addition, the antenna apparatuses 100*c* and 100*d* are arranged to be parallel to a side direction of the antenna module and may be encapsulated by a second dielectric layer 1140*c*.

Figure 11A:
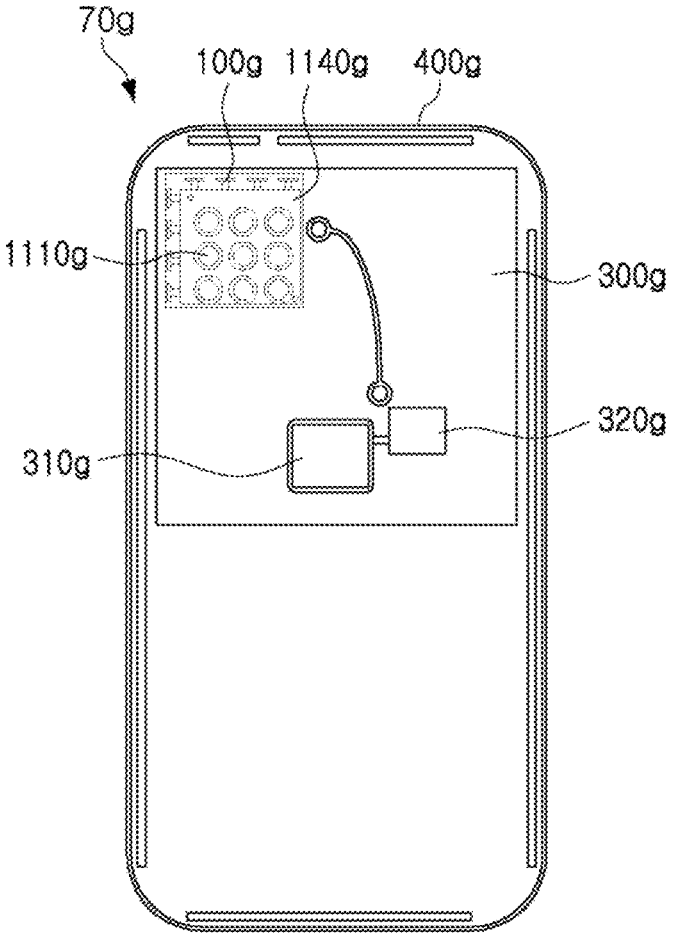
FIGS. 11A and 11B are views illustrating example layouts of an antenna module in an electronic device according to eighteenth and nineteenth embodiments.
Figure 11B:
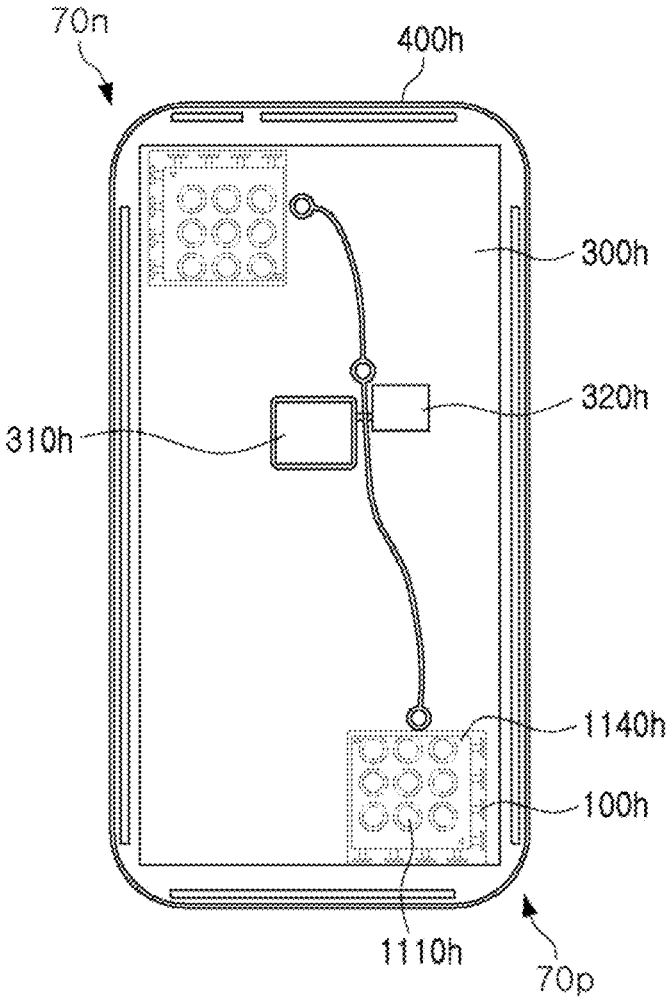

FIGS. 11A and 11B are views illustrating example layouts of an antenna module in an electronic device according to eighteenth and nineteenth embodiments of the present disclosure.

Referring to FIG. 11A, an antenna module 70*g* including an antenna apparatus 100*g*, a first director member 1110*g*, and a dielectric layer 1140*g* are disposed to be adjacent to a side boundary of an electronic device 400*g* on a substrate 300*g* of the electronic device 400*g*.

The electronic device 400*g* may be a smartphone, a personal digital assistant, a digital video camera, a digital still camera, a network system, a computer, a monitor, a tablet, a laptop, a netbook, a television, a video game, a smartwatch, an automotive component, or the like, but is not limited thereto.

A communications module 310*g* and a baseband circuit 320*g* are further disposed on the substrate 300*g*. The communications module 310*g* includes at least a portion of a memory chip such as a volatile memory (for example, a DRAM), a non-volatile memory (for example, a ROM), a flash memory, or the like; an application processor chip such as a central processor (for example, a CPU), a graphics processor (for example, a GPU), a digital signal processor, a cryptographic processor, a microprocessor, a microcontroller, or the like; and a logic chip such as an analog-digital converter, an application-specific IC (ASIC), or the like.

The baseband circuit 320*g* generates a base signal by performing analog-digital conversion, and amplification, filtering, and frequency conversion of an analog signal. The base signal input and output from the baseband circuit 320*g* is transmitted to the antenna module through a cable.

For example, the base signal is transmitted to the IC through the electrical connection structure, the core via, and the wiring layer illustrated in FIG. 9. For example, the IC converts the base signal into an RF signal of a millimeter wave (mmWave) band.

Referring to FIG. 11B, two or more antenna modules 70*n*, 70*p* each including an antenna apparatus 100*h*, a first director member 1110*h*, and a dielectric layer 1140*h* are disposed to be adjacent to a boundary of one side surface of an electronic device 400*h* and a boundary of the other side surface thereof, respectively, on a substrate 300*h* of the electronic device 400*h*. A communications module 310*h* and a baseband circuit 320*h* are further disposed on the substrate 300*h*.

The wiring layer, the feed line, the feed via, the antenna member, the ground layer, the shielding via, the director member, the director via, the feed via, the electrical connection structure, and the plating member disclosed herein may include a metal material (e.g., a conductive material such as copper (Cu), aluminum (Al), silver (Ag), tin (Sn), gold (Au), nickel (Ni), lead (Pb), titanium (Ti), an alloy thereof, or combinations thereof), and may be formed by a plating method such as chemical vapor deposition (CVD), physical vapor deposition (PVD), sputtering, subtractive, additive, semi-additive process (SAP), modified semi-additive process (MSAP), and the like, or combinations thereof, but is not limited thereto.

The RF signal disclosed herein may have a format according to wireless fidelity (Wi-Fi) (Institute of Electrical And Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+ (HSPA+), high speed downlink packet access+ (HSDPA+), high speed uplink packet access+ (HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth, 3G, 4G, and 5G protocols, and any other wireless and wired protocols designated after the abovementioned protocols, but is not limited thereto.

As set forth above, according to the examples and embodiments of the present disclosure, the antenna module may omni-directionally expand the transmission and reception direction of the RF signal by forming the radiation patterns for transmission and reception of the RF signal in the first and second directions which are different from each other, and may improve the antenna performance (e.g., the transmission and reception rate, the gain, the bandwidth, directivity, and the like) in the second direction.

In addition, the example antenna modules according to the embodiments of the present disclosure may be easily miniaturized while improving the transmission and reception performance of the RF signal in the first and second directions.

The example antenna modules according to the embodiments of the present disclosure may have precisely adjusted antenna performance by improving a degree of freedom of a design of the director member.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a feed line extended in a forward direction;

a dipole antenna member electrically connected to the feed line and having first and second poles; and a director member disposed in front of the first and second poles, wherein the director member is bent so that first and second end portions of the director member are more forwardly positioned than a linear center portion of the director member, wherein the linear center portion of the director member is disposed in parallel with the first and second poles, wherein the director member comprises a first bent portion connected between the first end portion and the linear center portion, and a second bent portion connected between the second end portion and the linear center portion, and wherein lengths of each of the first and second bent portions are longer than lengths of each of the first and second end portions.

2. The antenna apparatus of claim 1, wherein the director member is longer than a length of the first pole, longer than a length of the second pole, and shorter than a unified length of the first pole and the second pole.

3. The antenna apparatus of claim 1, wherein an angle of inclination of the first bent portion and an angle of inclination of the second bent portion in the director member are greater than or equal to 5° and less than or equal to 14°.

4. The antenna apparatus of claim 1, wherein the lengths of each of the first and second bent portions are longer than a length of the linear center portion.

5. The antenna apparatus of claim 1, each of widths of the first and second end portions of the director member is shorter than a width of the linear center portion of the director member.

6. The antenna apparatus of claim 1, wherein the director member is disposed to overlap with a space between the first pole and the second pole, in view of the forward direction.

7. The antenna apparatus of claim 1, wherein a combination shape of the first and second poles is a folded-dipole shape.

8. The antenna apparatus of claim 1, further comprising a director via connected to the director member.

9. The antenna apparatus of claim 8, further comprising a feed via connected between the feed line and the dipole antenna member.

10. The antenna apparatus of claim 1, further comprising:

a ground layer disposed in rear of the first and second poles; and a second feed line electrically connected to the second pole, wherein the feed line is electrically connected to the first pole, and wherein the ground layer surrounds a portion of the feed line and surrounds a portion of the second feed line.

11. The antenna apparatus of claim 1, further comprising a ground layer disposed in rear of the first and second poles, wherein a front boundary of the ground layer is recessed.

12. The antenna apparatus of claim 11, further comprising shielding vias disposed along the front boundary of the ground layer.

13. The antenna apparatus of claim 12, wherein the director member is longer than a length of the first pole, longer than a length of the second pole, and shorter than a unified length of the first pole and the second pole.

14. The antenna apparatus of claim 11, further comprising at least one second dipole antenna member disposed in front of the ground layer, wherein the front boundary of the ground layer is further recessed in rear of the at least one second dipole antenna member.

15. The antenna apparatus of claim 14, further comprising:

at least one second director member disposed in front of the at least one second dipole antenna member, wherein the at least one second director member is bent so that first and second end portions of the at least one second director member are more forwardly positioned than a center portion of the at least one second director member.

16. The antenna apparatus of claim 1, further comprising:

a ground layer disposed in rear of the first and second poles;

at least one second dipole antenna member disposed in front of the ground layer; and at least one second director member disposed in front of the at least one second dipole antenna member.

17. The antenna apparatus of claim 16, further comprising shielding vias disposed along a front boundary of the ground layer.

18. An antenna apparatus, comprising:

a feed line extended in a forward direction;

a dipole antenna member electrically connected to the feed line and having first and second poles;

a director member disposed in front of the first and second poles;

a ground layer disposed in rear of the first and second poles; and shielding vias disposed along a front boundary of the ground layer, wherein the front boundary of the ground layer comprises a recessed portion, and wherein the feed line is extended into the recessed portion.

19. An antenna apparatus, comprising:

a feed line extended in a forward direction;

a dipole antenna member electrically connected to the feed line and having first and second poles;

a director member disposed in front of the first and second poles;

a ground layer disposed in rear of the first and second poles; and at least one second dipole antenna member disposed in front of the ground layer, wherein a front boundary of the ground layer is recessed in rear of the at least one second dipole antenna member.

20. An antenna apparatus, comprising:

a feed line extended in a forward direction;

a dipole antenna member electrically connected to the feed line and having first and second poles; and a director member disposed in front of the first and second poles, wherein the director member is bent so that first and second end portions of the director member are more forwardly positioned than a linear center portion of the director member, wherein the linear center portion of the director member is disposed in parallel with the first and second poles, wherein the director member comprises a first bent portion connected between the first end portion and the linear center portion, and a second bent portion connected between the second end portion and the linear center portion, and wherein an angle of inclination of the first bent portion and an angle of inclination of the second bent portion in the director member are greater than or equal to 5° and less than or equal to 14°.

* * * * *